US009418514B2

(12) United States Patent
Watkins

(10) Patent No.: US 9,418,514 B2
(45) Date of Patent: Aug. 16, 2016

(54) METHOD, APPARATUS, AND PROGRAM PRODUCT FOR CONTROLLING CONTRIBUTIONS TO PROGRESSIVE PRIZE POOLS

(71) Applicant: Everi Games Inc., Austin, TX (US)

(72) Inventor: Brian Alexander Watkins, Austin, TX (US)

(73) Assignee: EVERI GAMES INC., Austin, TX (US)

( * ) Notice: Subject to any disclaimer, the term of this patent is extended or adjusted under 35 U.S.C. 154(b) by 147 days.

(21) Appl. No.: 14/019,076

(22) Filed: Sep. 5, 2013

(65) Prior Publication Data

US 2015/0065234 A1 Mar. 5, 2015

(51) Int. Cl.
*G07F 17/32* (2006.01)

(52) U.S. Cl.
CPC ..... *G07F 17/3258* (2013.01)

(58) Field of Classification Search
USPC ..... 463/27, 28
See application file for complete search history.

(56) References Cited

U.S. PATENT DOCUMENTS

| | | | | |
|---|---|---|---|---|
| 4,624,459 | A | 11/1986 | Kaufman | |
| 5,280,909 | A | 1/1994 | Tracy | |
| 5,655,961 | A | 8/1997 | Acres et al. | |
| 5,766,076 | A | 6/1998 | Pease et al. | |
| 6,012,982 | A | 1/2000 | Piechowiak et al. | |
| 6,110,043 | A | 8/2000 | Olsen | |
| 6,168,523 | B1 | 1/2001 | Piechowiak et al. | |
| 6,210,275 | B1 | 4/2001 | Olsen et al. | |
| 6,319,125 | B1 | 11/2001 | Acres | |
| 6,358,149 | B1 | 3/2002 | Schneider et al. | |
| 7,419,429 | B2 | 9/2008 | Taylor | |
| 7,607,976 | B2 | 10/2009 | Baerlocher et al. | |
| 7,651,394 | B2 | 1/2010 | Johnson | |
| 7,780,520 | B2 | 8/2010 | Baerlocher | |
| 8,282,474 | B2 | 10/2012 | Caspers et al. | |
| 2003/0030211 | A1 | 2/2003 | Brown | |
| 2008/0020830 | A1 * | 1/2008 | Ikehara | G07F 17/3258 463/27 |
| 2008/0020831 | A1 * | 1/2008 | Ikehara | G07F 17/3258 463/27 |
| 2008/0108430 | A1 | 5/2008 | Evans | |
| 2008/0153564 | A1 * | 6/2008 | Baerlocher | G07F 17/32 463/16 |
| 2008/0182657 | A1 | 7/2008 | Bennett et al. | |
| 2008/0287185 | A1 | 11/2008 | Yoseloff et al. | |
| 2012/0283006 | A1 * | 11/2012 | Baerlocher | G07F 17/32 463/27 |
| 2013/0225278 | A1 * | 8/2013 | Kniesteadt | G07F 17/32 463/27 |
| 2015/0269812 | A1 * | 9/2015 | Michaelson | G06Q 40/04 463/27 |

* cited by examiner

*Primary Examiner* — Pierre E Elisca
(74) *Attorney, Agent, or Firm* — Russell D. Culbertson, Esq.; Nathan Calvert, Esq.; J. P. Cody, Esq.

(57) ABSTRACT

A method for controlling contributions to a progressive prize pool includes randomly determining whether a progressive pool growth event is triggered for the given play input in a wagering game. Where it is determined that a progressive pool growth event is triggered, the contribution amount is determined and the progressive pool is increased by this contribution amount. Where multiple progressive pools are maintained in a system, additional steps are taken to identify which pool or pools are to be increased when a progressive pool growth event is triggered.

20 Claims, 4 Drawing Sheets

METHOD, APPARATUS, AND PROGRAM PRODUCT FOR CONTROLLING CONTRIBUTIONS TO PROGRESSIVE PRIZE POOLS

TECHNICAL FIELD OF THE INVENTION

The invention relates to wagering games which offer one or more progressive prizes. More particularly, the invention provides a method, gaming apparatus, and program product which controls the contributions to one or more progressive prize pools so as to increase player interest and excitement during the course of play in the wagering games eligible for prizes from the one or more progressive prize pools.

BACKGROUND OF THE INVENTION

Wagering games commonly provide prizes based on a predefined pay table. Prizes based on a predefined pay table equate a graphically represented result in the wagering game with a pay table prize defined for that result. In the case of reel-type wagering games in which results are displayed through symbol combinations shown on a series of mechanical or video-generated spinnable reels which have each been stopped at a particular angular orientation, a symbol combination shown on the stopped reels such as a line of three of the same symbol may be shown in a pay table for the game as correlating to a prize in currency, credits, or other value. In the example of a playing card game such as a video poker game, a pay table for the game may equate various playing card hands to a respective prize value which is paid to the player upon achieving the respective hand in a play of the game.

In addition to or in lieu of prizes based on a predefined pay table, wagering games may also provide progressive prizes. Progressive prizes are commonly prizes that do not have a fixed value. These types of prizes have commonly been funded by a certain percentage of each qualifying wager placed in a given wagering game and perhaps other wagering games that are linked for the progressive prizes. For example, 1% of each wager placed at a given gaming machine may be allocated to a progressive prize pool. Thus for every one dollar wager placed at such a gaming machine, the progressive prize pool is incremented by one cent. All or some fraction of the amount accumulated in the progressive pool may be awarded to a player in response to a progressive prize winning event in the progressive game system. The progressive prize winning event may be a particular result in a wagering game operated by the player or may be defined in any other suitable manner. Once the progressive prize is awarded from the progressive pool, the amount of the prize is deducted from the pool value and the pool may be reset at some minimum value by adding a progressive prize seed value which may be funded by the progressive system operator.

The amount of the progressive prize awarded for a given progressive prize winning event and the definition of the progressive prize winning event may be related in some progressive gaming systems. For example, "must-hit-by" style progressive prizes are defined by an "award-at" value accumulated in a progressive pool, and the progressive prize winning event is defined as the play in the underlying wagering game which causes the progressive prize pool to reach that award-at value. This award-at value, which is concealed from the players, may be defined randomly within a certain range for the progressive prize pool. If a given wager in a participating game increments the accumulated value of the progressive prize pool to the defined award-at progressive prize value, the player making that wager wins the progressive prize amounting to the award-at progressive prize value.

Progressive prize gaming systems may maintain multiple different progressive prize pools, each providing a different progressive prize. Different progressive prize pools are commonly defined as different tiers at different maximum values. A wager in a participating game may be used to increment the value of some subset of the progressive prize pools or all of the progressive prize pools.

Progressive prizes have been popular among casino patrons for a number of reasons. One reason for the popularity is that a large number of gaming machines, perhaps even located at different gaming facilities, may be linked to accumulate the progressive prize pool or pools. Collecting contributions from a large number of gaming machines allows the progressive prize pools to collect large values, and thus progressive prizes may be very large, commonly much larger than prizes in the predefined pay tables for the underlying wagering games. However, despite the popularity of progressive prizes and the progressive gaming systems that offer such prizes, there remains a need in the gaming industry to devise new types of progressive gaming systems and methods to capture and hold player interest.

SUMMARY OF THE INVENTION

The invention encompasses methods, apparatus, and program products for controlling contributions to progressive prize pools in a fashion that increases player excitement and interest in the underlying wagering games utilizing the progressive prize pools. Rather than increasing the progressive prize pools by a percentage of each wager in the underlying wagering games or by a percentage of each win in the underlying wagering games, implementations of the present invention increase the progressive pools randomly. Thus on some plays in a wagering game according to the present invention, a progressive pool is not increased at all, while on other plays the progressive pool may be increased significantly. The sudden and random increase in progressive prize pool value generates player excitement, particularly in must-hit-by style progressive games.

A method for controlling contributions to one or more progressive prize pools used for one or more wagering games may include receiving a play input for a wagering game and displaying a representation of the result for the play input. The play input will be associated with a wager for the wagering game, and the play input will typically be entered through a player input system associated with a gaming machine. Various alternative processes for obtaining the result for the play input will be described below in connection with the example gaming machine and process shown in the figures. Implementations of the present invention include randomly determining whether a progressive pool growth event is triggered for the given play input. This random determination is made under control of the one or more data processing devices associated with the gaming machine and is separate from the process of obtaining the result for the play input. Where it is determined that a progressive pool growth event is triggered for a play input, a contribution amount is then applied to increase at least one of the one or more progressive prize pools.

A method according to the present invention may also include awarding any prize associated with the result for the play input and awarding a progressive prize from at least one of the one or more progressive pools, the latter being responsive to a progressive prize triggering event. Both of these awarding steps may be performed under control of the one or more data processing devices associated with the gaming machine.

Randomly determining whether a progressive pool growth event is triggered separate or separately from the process of obtaining the result for the play input in the context of this disclosure and the accompanying claims means that the random determination is at least partially different from or independent from the process of obtaining the result for the play input and is not merely the selection between potential results for the play input. For example, the random determination may be based on a random number generated completely separately from a process employed to obtain a result for the play input. That is, one or more random numbers may be obtained to identify a result for the play input, and then a different random number generation process may be employed to make the random determination as to whether a progressive pool growth event is triggered for the given play input. As another example, a random number generated in the process of obtaining a result for the play input, but not itself defining the result, may be used independently of that result to make the random determination as to whether a progressive pool growth event is triggered for the play input.

Also, it should be noted that any random determination or selection made in implementations of the present invention may be a true random or pseudo-random determination or selection. These random determinations or selections, whether truly random or pseudo-random, may be made in any suitable manner.

In some implementations of the present invention not all play inputs are eligible for providing a progressive pool contribution. Thus implementations of the invention may include determining if a given play input is eligible for providing a progressive pool contribution, and the random determination regarding whether a progressive pool growth event is triggered is made in response to a determination that the play input is eligible for providing a progressive pool contribution. In one preferred form of the invention a given play input is eligible for providing a progressive prize pool contribution when the result obtained for the play input is not associated with a prize, for example, when the result for the play input does not itself entitle the player to a prize according a pay table defined for the wagering game.

Various forms of the invention may include additional random determinations or selections in the course of accumulating the progressive prize pool or pools. For example, a random selection may be made to identify the respective contribution amount to be applied to increase the one or more progressive prize pools. Where there are multiple progressive prize pools, a separate random selection may be made to identify which of the different progressive prize pools are to be increased for the play input.

Some forms of the invention may make the desired random contributions to the various progressive prize pools in dependence on a wager level defined for the wagering game. Thus forms of the invention may additionally determine if a given wager in the wagering game is at a first wager level or a different, second wager level. The probability of making a respective progressive prize pool contribution for a given play input may be dependent upon whether the wager is at the first wager level or second wager level. Also, the apportionment of a given progressive prize pool contribution may be dependent upon whether the wager is at the first wager level or second wager level.

A gaming machine according to one embodiment of the present invention includes a display system having at least one display device, a player input system, and at least one processor. One or more memory devices are associated with the processor or processors for storing instructions which are executable by the processor or processors to receive the play input for the wagering game through the player input system, and to cause the display system to display a representation of the result for the play input. The instructions may also be executable to, separately from the process of obtaining the result for the play input, randomly determine whether a progressive pool growth event is triggered for the play input, and where the progressive pool growth event is triggered for the play input, increase at least one of the one or more progressive prize pools by the contribution amount. Additional instructions may be stored which are executable to cause the display system to display an award of any prize associated with the result for the play input, and responsive to a progressive prize triggering event, cause the display system to display an award of a progressive prize from at least one of the one or more progressive pools. Further instructions may be stored which are executable to make the other random determinations or selections which may be made in the system.

Considering that the present invention may be implemented using one or more general purpose processing devices, the invention also encompasses program products which may each be stored on one or more tangible computer readable data storage devices representing non-transitory media. A program product according to the present invention may include player input program code, game program code, and progressive pool control program code. The player input program code in this example program product is executable by at least one processor to receive a play input entered through a player input system of the gaming machine, while the game program code is executable to cause a result display system of the gaming machine to display a representation of the result for the play input. The progressive pool control program code is executable to, separately from a process of obtaining the result for the play input, randomly determine whether a progressive pool growth event is triggered for the play input, and, where the progressive pool growth event is triggered, increase at least one of the one or more progressive prize pools by a respective contribution amount. The progressive pool control program code may also be executable to perform the other random determinations or selections described above and in more detail in the following sections. Program products according to the present invention may also include game payout program code executable to award any prize associated with the result for the play input. Progressive prize payout program code may also be included and is executable to award a progressive prize from one or more progressive pools responsive to a progressive prize triggering event.

These and other advantages and features of the invention will be apparent from the following description of illustrative embodiments, considered along with the accompanying drawings.

DESCRIPTION OF ILLUSTRATIVE EMBODIMENTS

In the following description, FIGS. 1-3 will be used to describe example gaming machines and gaming networks through which the present invention may be implemented. Processes which are illustrative of various embodiments of the invention will then be described in connection with the flow chart of FIG. 4.

Figure 1:
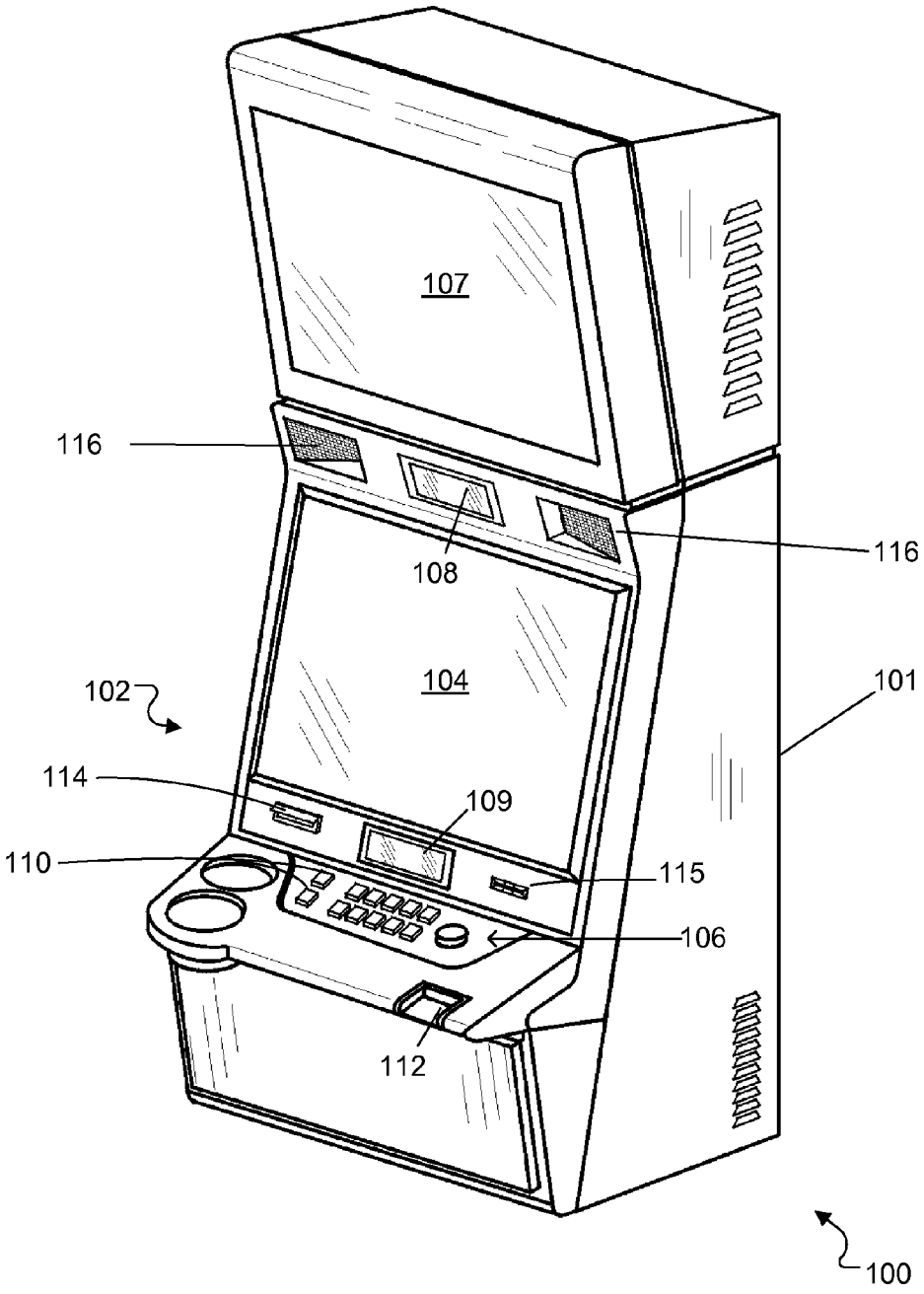
FIG. 1 is a view in perspective of a gaming machine which may be employed in embodiments of the present invention.

FIG. 1 shows a gaming machine 100 that may be used in implementing a wagering game utilizing one or more progressive prize pools according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display game symbols which show the results for a given play of the game implemented through gaming machine 100. Such results may be shown by the manner in which game symbols are aligned along various paylines defined through a symbol location matrix presented by the display device 104. As will be described further below in connection with FIG. 2 and elsewhere, it is also possible for gaming machines within the scope of the present invention to include mechanical elements such as mechanical reels. One or more of the video display devices may also be used to show results in the form of a hand of playing cards, a dice roll, a horse race, or in any other fashion in which a result may be displayed. Generally, the display device or display devices of the gaming machine, whether video display devices, mechanical devices, or combinations of the two, which are used to display games according to embodiments of the invention, may be described in this disclosure and the accompanying claims as a display system.

The gaming machine 100 illustrated for purposes of example in FIG. 1 also includes a number of mechanical control buttons 110 mounted on button panel 106. These control buttons 110 may allow a player to select a bet level, select paylines, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls. The player interface devices which receive player inputs to initiate the play of a game through the gaming machine, such as controls to select a wager amount for a given play and controls to enter a play input to actually start a given play in the wagering game, may be referred to generally as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
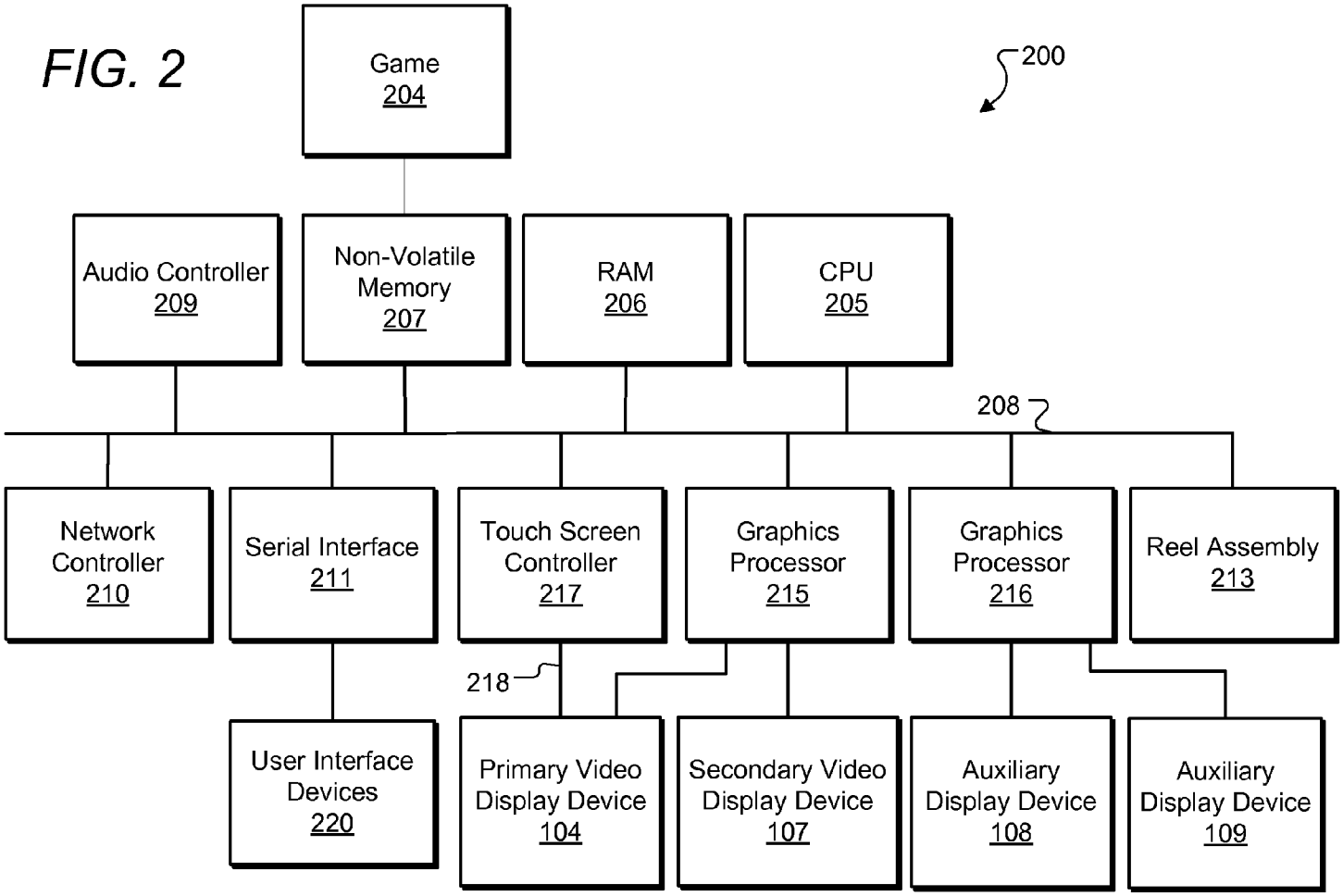
FIG. 2 is a diagrammatic representation of the gaming machine shown in FIG. 1 showing various components of the gaming machine.

FIG. 2 shows a logical and hardware block diagram 200 of gaming machine 100 which includes a central processing unit (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a stand-alone gaming machine and a gaming machine (that is, the part housed in a cabinet such as cabinet 101 in FIG. 1) along with one or more remote components for providing various functions (such as generating outcomes for plays in a game, and driving display devices mounted in a gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include the player input program code, game program code, progressive pool control program code, game payout program code, and progressive prize payout program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the invention may include mechanical reels. For example, a set of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
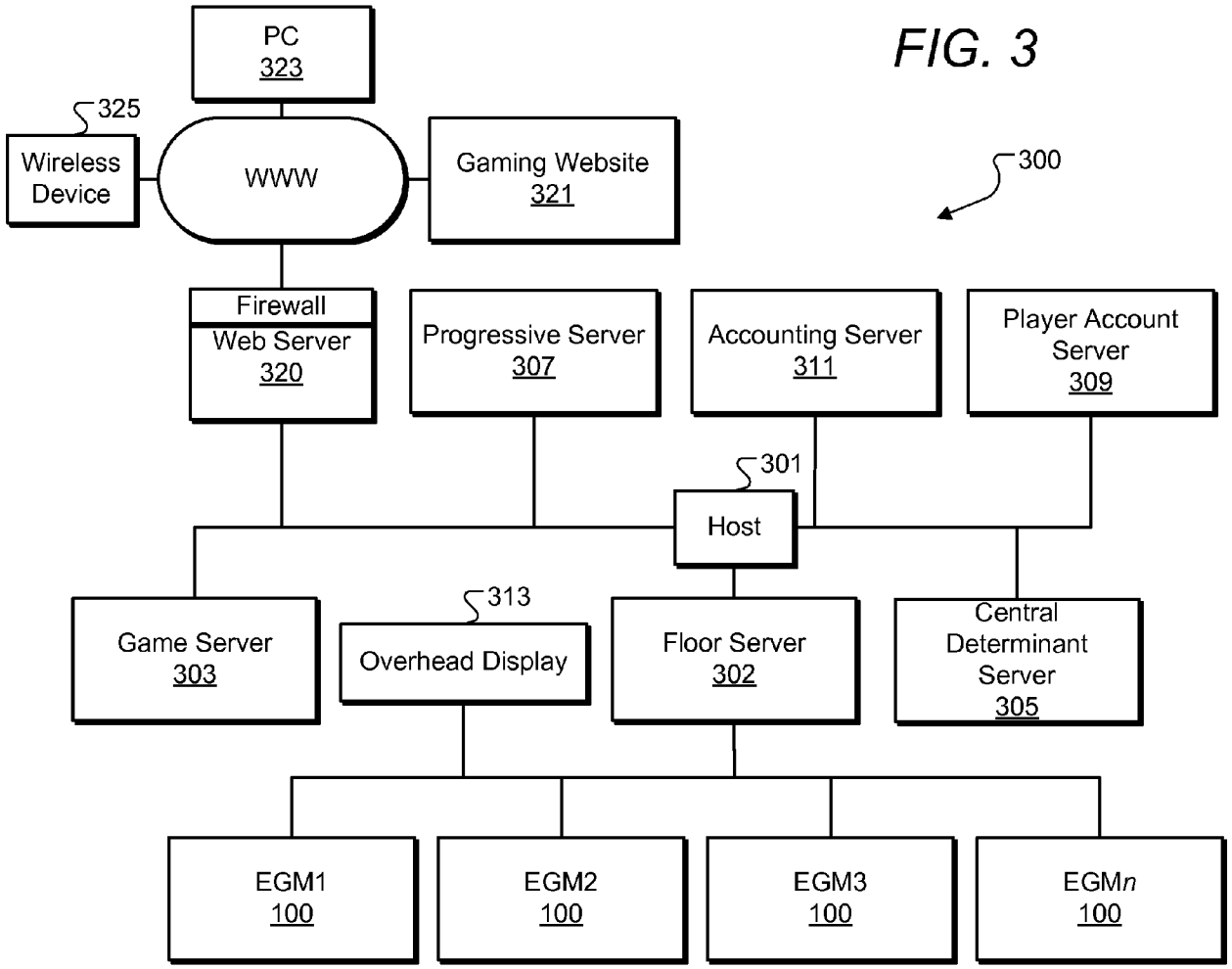
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 may be stored by a display controller or game processor 205 of the given gaming machine and transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the information to networked gaming machines 100 which present the games to players.

Progressive server 307 may maintain progressive pools according to the present invention. In some implementations, progressive server 307 may simply receive communications indicating contribution amounts which have been determined by processes executing at the various gaming machines 100 or elsewhere in the gaming network. Alternatively, progressive server 307 may perform processes to at least participate in determining if a progressive pool growth event is triggered for a given play input at a gaming machine 100, in determining if a play input is eligible for a progressive pool growth event, or in determining the contribution value or allocations between different pools, for example. Progressive server 307 may also periodically communicate current pool values back to the various gaming machines 100, and may participate in communicating awarded progressive prize amounts to the gaming machines and making adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged onto website 321 the player may play various games on the website, including games offering progressive prizes according to the invention in some cases. Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which wagering games featuring randomly growing progressive prize pools according to embodiments of the present invention may be implemented, and is not intended to be limiting in any way. The invention is not limited to use in games offered through a gaming network (via the gaming website 321, or via gaming machines such as gaming machines 100, or otherwise). For example, games including progressive pool control according to the present invention may be offered through a stand-alone gaming machine having a configuration similar to gaming machine 100 or having any other gaming machine configuration. Also, where games including progressive pool control as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

Figure 4:
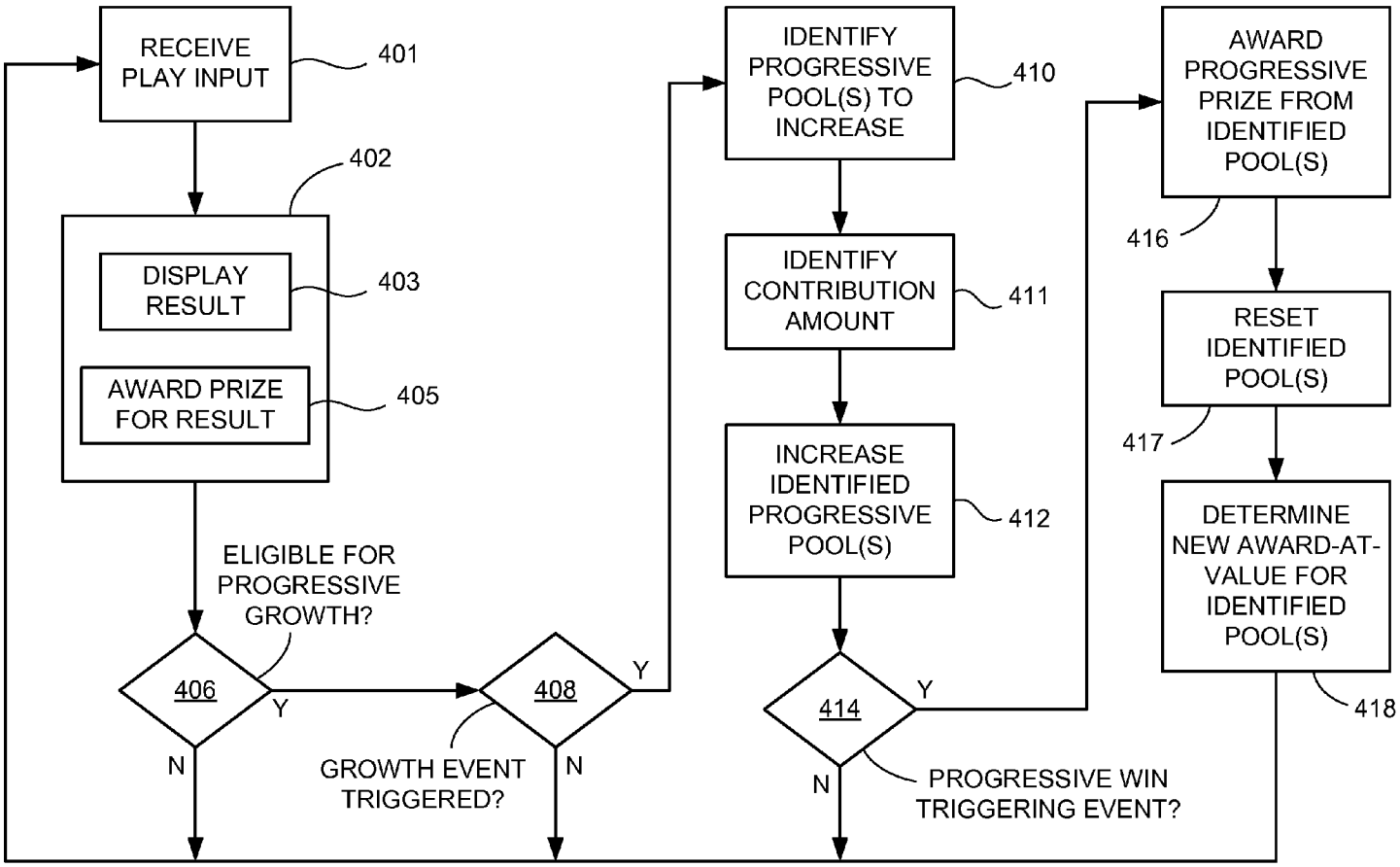
FIG. 4 is a flow diagram illustrating a process flow according to one or more embodiments of the present invention.

FIG. 4 is a flowchart showing an example progressive pool control method according to various implementations of the invention. This example method includes first receiving a play input at a gaming machine as shown at process block 401. The method also includes conducting a game play sequence for the play input as shown at process block 402. In this case the game play sequence includes displaying a result for the play input at process block 403 and awarding a prize for the result at process block 405. As indicated by decision block 406, the illustrated method also includes making a determination as to whether the progressive pools are eligible for progressive growth for that particular play input received at process block 401. If not, the process loops back to receive the next play input at process block 401. If it is determined that the progressive prize pools are eligible for progressive growth for that play input, it is determined whether a growth event is triggered for that play input as indicated at decision block 408. If a growth event is not triggered, the process loops back to receive the next play input at process block 401. However, if a growth event is triggered as indicated by an affirmative outcome at decision block 408, the method includes identifying which progressive pool or pools to increase as shown at process block 410, identifying the contribution amount as indicated at process block 411, and then increasing the identified progressive pool or pools as indicated at process block 412.

The method illustrated in FIG. 4 next includes determining whether a progressive win triggering event has occurred as indicated by decision block 414. If there has been no progressive win triggering event, the process simply loops back to receive the next play input at process block 401. If a progressive win triggering event has occurred, the method includes awarding a progressive prize from the identified pool or pools as indicated at process block 416. The method also includes resetting the identified pool or pools as indicated at process block 417, and determining a new award-at value for the identified pool or pools as indicated at process block 418. After this last determination the process loops back to receive the next play input at process block 401.

The process shown in FIG. 4 is specific to a particular play input received at a gaming machine for a wager which is potentially eligible to fund a progressive pool and which is potentially eligible for a progressive win. Thus at any point in time in a gaming system implementing the invention, a number of separate instances of this example process may be in progress. Among these separate instances, the underlying wagering game for which the respective play input is received at process block 401 may be the same game or different games. For example, one of the wagering games contributing to the progressive pool or pools may be a first type of reel-type (slot machine) game, while another one of the wagering games contributing to the progressive pool(s) may be a different type of reel-type game. Still other wagering games contributing to the progressive pool(s) may be video card games such as video poker, or any other type of game.

It should also be noted that the process shown in FIG. 4 omits an initialization step which is typically required before a gaming machine is in condition to receive a play input and also does not show a step of initializing the progressive pool or pools affected by the process. Methods according to the invention may be employed in gaming systems that utilize any gaming machine initialization process. For example, it may be necessary for a player to log in at a given gaming machine using a player identifier or player card in order to place the gaming machine in condition to receive a game play input to initiate a play in the game. As another example, it may only be necessary for a player to insert cash into the gaming machine or insert a cash-in ticket or otherwise place value on the gaming machine (that is, in memory associated with the gaming machine) to place the gaming machine in condition to receive a game play input to initiate a play in the game. As for initializing the progressive pool or pools, this may be accomplished in a gaming system employing methods according to the invention by setting the pool value to an initial seed value. For must-hit-by style progressive games the pool initialization step may also include determining an award-at value for each pool in play. These steps of initializing the gaming machine and initializing the progressive pools at the outset of play in the progressive gaming system are omitted from FIG. 4 so as not to obscure the invention in unnecessary detail.

The invention encompasses any arrangement by which a play input may be received as shown at process block 401 and any game sequence for that play input such as the example sequence shown at process block 402. A play input is commonly received through a player input system associated with the gaming machine such as one of the player interface devices 220 shown in FIG. 2. For example, a "PLAY" button on button panel 106 in FIG. 1 or a virtual "PLAY" button implemented on a touch screen associated with display device 104 in that Figure may be used to send a play input which is received by the gaming machine CPU 205 (FIG. 2). In any case, the play input will be associated with a wager for the respective play at the gaming machine. The wager may be expressed in terms of the credit value, monetary value, or in any other fashion, and may be selected separately from activating a "PLAY" button using wager level controls included on a player control button panel such as panel 106 in FIG. 1, or elsewhere on the gaming machine.

Although not shown in FIG. 4, the game sequence included at process block 402 may include a separate step of obtaining a game result in some fashion and then displaying the result as indicated at process block 403. Because a progressive pool control system according to the present invention may be applied to class II and class III gaming systems, and any other gaming system which may provide progressive prizes, obtaining a game result for the play input may be performed in any number of ways. For example, results may be obtained through a bingo game as in a class II gaming system, or may be obtained by drawing a lottery record as in some class III gaming systems. Alternatively, a result may be dictated by a number of elements randomly displayed as a result at process block 403 and then the result identified from evaluating that display. This latter arrangement for obtaining a result for the game input would be the case where the underlying game is a reel-type game utilizing independent random reel stops to identify a result for the play input. It should also be noted that the step of awarding a prize for the result for the given play input shown at process block 405 in FIG. 4 need not be performed immediately after displaying the result and before any of the other steps shown in the process. Rather, any prizes for a winning result for the play input may be awarded at any suitable point in the process such as part of an end play sequence prior to returning to receive the next play input at process block 401. Regardless of when any prize is awarded for the result obtained for the play input, the prize may be awarded in cash, credits, physical objects, or in any other type of value or benefit. Where prizes for the game result are awarded in cash or credits, the prize may be awarded by incrementing a win or cash-out meter associated with the gaming machine. Of course, cash prizes and some other types of physical prizes may be dispensed by a suitable mechanism at the gaming machine, and large value prizes of any type may be awarded via a hand pay process as is known in the art.

The underlying game for which a play input is received at process block 401 in FIG. 4 may include displaying a single result for a base game, or may include displaying a result for one or more additional related games, such as secondary or bonus games. For example, a game play sequence such as that shown at process block 402 in FIG. 4 may include displaying results for one or more bonus games which are enabled based on the result in a base game or enabled in any other fashion. These secondary or bonus game results may be displayed as indicated at process block 403 or may be displayed at any other suitable point in the process shown in FIG. 4.

Although the process shown in FIG. 4 includes a separate step indicated at decision block 406 for determining whether the given play input is eligible for progressive growth, other forms of the invention may make all play inputs eligible for progressive growth. Where particular eligibility parameters must be met, any suitable parameter may be employed to determine eligibility. One preferred arrangement requires that the result displayed for the respective play input be a non-winning result that is not correlated to a prize in the underlying wagering game through a pay table for the underlying game or otherwise.

Regardless of whether only some or all play inputs are eligible for increasing one or more progressive pools, a method according to the invention will include the step indicated at process block 408 in which it is randomly determined whether a growth event is triggered for that play input. For example, the determination may be made by obtaining a random number in a given range from a random number generator and comparing that random number to a subset of numbers within that range. If the random number is within the subset, a growth event is deemed triggered and otherwise not triggered. The range of numbers for the random draw and the subset within that range may be selected to provide a desired probability of a growth event for a given play input, and this probability may change from one instance of the process shown in FIG. 4 to the next as will be discussed further below.

The process shown in FIG. 4 assumes that multiple different progressive pools are being maintained by the system. Thus the method includes the step shown that process block 410 of identifying which progressive pool or pools to increase for the given play input. Any suitable process may be used to select the progressive pool or pools to increase. For example the progressive pool or pools may be selected randomly. Some forms of invention control the random process to provide a certain probability of increase for each pool on a given play input. It is also possible that an implementation of the present invention may maintain only a single progressive pool from which progressive prizes are awarded.

It is assumed in the process shown in FIG. 4 that the contribution amount, that is, the amount by which the identified progressive pool is increased for a given play input, varies in some fashion. Thus the process includes the step of identifying the contribution amount as shown at process block 411. It should be appreciated that other forms of the invention may utilize a static contribution amount thus obviating the need for the step shown at process block 411. In forms of the invention that require the contribution amount identifying step, any suitable method may be used to identify the contribution amount. Some preferred forms of the invention identify the contribution amount randomly using a random number generator in a process similar to that described above in connection with decision block 408. In this random contribution amount identification case, the process may be devised so as to ensure a desired distribution of contribution amounts which may be identified and a desired probability of selections associated with each potential contribution amount. It should also be noted that the two steps shown at process blocks 410 and 411 may be combined into a single step which both identifies the progressive pools to increase and identifies contribution amount utilizing a single random or other process. The amount of the contribution may be in units of currency (pennies for example), or may be a percentage of the wager associated with the given play input received at process block 401, or may be defined in any suitable fashion. It will be appreciated that the contribution amount will commonly be limited to provide a desired overall payout for the gaming system including both payouts for the results displayed as shown at process block 403 and progressive wins awarded as shown at process block 416.

Regardless of how the progressive pool or pools are identified for a given increase and the amount of the increase, a method according to the invention will include increasing the identified progressive pool or pools as shown at process block 412. The value of each progressive pool may be maintained by a virtual or other meter which is incremented by the desired contribution amount to increase the respective pool. Such a progressive pool meter for a respective pool may be maintained at a server such as progressive server 307 shown in FIG. 3. Alternatively, each gaming machine may include a respective meter and the various gaming machines may communicate with each other as necessary to maintain the progressive pool meters in parallel.

The process shown in FIG. 4 illustrates a must-hit-by progressive system and thus defines a progressive win triggering event as the condition in which a given increase in a progressive pool increases the pool value to an award-at value then in effect for that particular pool. Thus the process indicated at decision block 414 may comprise comparing the current value of a respective progressive pool after the increase indicated at process block 412 to a predetermined award-at value for the respective progressive pool. This comparison may be made at the gaming machine which received the play input as indicated at process block 401 or may be made at a progressive game server such as server 307 shown in FIG. 3, or some other server.

As noted above, implementations of the invention are not limited to any particular progressive win triggering event. The process conducted at decision block 414 to determine whether a progressive prize is triggered will typically be dependent upon how the progressive prize is triggered. For example, where a progressive prize is triggered randomly, the process may include drawing a random number from a range of numbers and comparing that drawn number to a subset of numbers in the overall range selected to provide a desired probability of triggering the progressive prize. As another example, a progressive prize triggering event may be defined as a certain number of plays of the underlying game or games. In this case the number of plays may be determined randomly and the process required for decision block 414 may be a comparison of a running count of game plays to the randomly determined value. As yet another example, a progressive win may be defined by some event in the gaming system. The occurrence of such an event may be indicated by setting a bit in a register, and the inquiry required at decision block 414 may include simply checking the status of that bit.

The step of awarding the progressive prize may include reducing or decrementing the identified pool or pools by the amount of the progressive prize being awarded. Where each pool value is maintained by a suitable virtual or hardware meter, the meter value may simply be decremented by the value of the progressive prize. This amount decremented from the identified pool or pools may be awarded to the player in any suitable manner. In some cases, the amount may simply be credited to a win or cash-out meter for the player at the particular gaming machine. Other gaming systems may require a hand pay to pay a progressive prize. This is particularly the case when the progressive prize is a large value prize. The value of the progressive prize awarded for a given progressive prize triggering event may be the entire value of the respective progressive pool or pools from which the progressive prize is paid. In other cases, the progressive prize for a given progressive prize triggering event may be defined as a certain percentage of the current pool value, defined as some fixed amount, or may be defined as some variable amount which varies according to one or more parameters. The value of a given progressive prize may also be determined randomly at any suitable point in the process shown as an example in FIG. 4.

The step of resetting the identified pools at process block 417 may reset each pool from which a progressive prize is awarded to some minimum value for that pool. The amount needed to reset the pool at the minimum value may be provided in any suitable manner and will typically be advanced by the casino operator or progressive game operator. For example, where the progressive prize reduced the respective progressive pool to zero, the operating casino may advance an amount to increase the value of that progressive pool from zero to the minimum value for the pool. From that reset value, the pool may be incremented randomly according to the invention until another progressive win triggering event for that respective pool.

Determining a new award-at value for the identified pool at process block 418 may be performed in any suitable manner at any processing device included in the gaming system. This step may be performed at a processor included with the gaming machine which received the play input as indicated at process block 401, or at a processor associated with a remote server such as progressive game server 307 in FIG. 3. In one implementation, a given progressive prize is defined as having a minimum value and a maximum value, and the award-at value for that pool is then determined in a random process as some value between the minimum and maximum. The random process may be controlled such that relatively higher award-at values may be determined in a given instance of the process. Regardless of how the award-at value is determined at process block 418, that value may be used in determining whether a progressive win event has occurred as discussed above in connection with decision block 414.

Although the process shown in FIG. 4 is specific to a must-hit-by style progressive gaming system, and thus includes determining a new award-at value as indicated at process block 418, the invention is not necessarily limited to this style of progressive gaming system. Rather, the invention of randomly increasing the progressive prize pools over the course of play in the underlying wagering game or games is applicable to any progressive gaming system regardless of how the value of the progressive prize is determined and regardless of what constitutes a progressive win triggering event. For example, although the progressive win triggering event for the process shown in FIG. 4 may be reaching the current award-at value for a given progressive pool, other implementations of the invention may trigger progressive prizes based on the result displayed for the play input as shown at process block 403, may trigger progressive prizes randomly regardless of the result for the play input, or in any other fashion.

As is apparent from the previous discussion, the invention is not limited to a single progressive pool. Rather, two or more progressive pools may be maintained in play for a given progressive system and for any given play in an underlying wagering game which is potentially eligible for a progressive prize. In one implementation, three different progressive pools are all maintained and a progressive prize may be awarded from any one of the pools on any given play in one of the underlying wagering games. Where multiple progressive pools are maintained in the progressive gaming system, each progressive pool may have a different minimum and maximum value.

In some forms of the invention the play input received at process block 401 in FIG. 4 may be associated with any one of the several different wager levels defined for the particular wagering game. Where different wager levels are available to the player, certain decisions and processes according to the present invention may be dependent in some fashion on the particular wager level. For example, where different wager levels are available, the probability of a growth event being triggered for a given play input as indicated at decision block 408 may be dependent upon the particular wager level. Also the step of identifying the progressive pool to increase and identifying the contribution amount as indicated at process blocks 410 and 411, respectively, may also be dependent upon the wager level for the given play input. In this way, all wager levels can be eligible for the progressive prizes, but higher wager levels may afford more lucrative growth parameters for the progressive pools to give equitable pay percentage value for higher wagers, or even a higher pay percentage for higher wagers.

For example, assume a particular wagering game has two wager levels, a one dollar level and a two dollar level. Assume also that the game has two progressive pools, a lower value pool and a higher value pool. In this case, a progressive gaming system according to the invention may be controlled such that for a one dollar wager, there is a 5% chance of triggering progressive growth on any eligible play input in accordance with decision block 408. If progressive growth is triggered, there may be a 60% chance that the lower progressive pool will be selected for growth in accordance with process block 410 in FIG. 4, and the remaining 40% chance that the higher progressive pool will be selected for growth. There may be a particular probability distribution for the contribution amount determined at process block 411 in FIG. 4 if the lower value progressive pool selected and a different probability distribution for the contribution amount if the higher value pool is selected. Continuing with this example, for a two dollar wager, there may be a 7% chance of triggering progressive growth on any eligible play. If progressive growth is triggered there may be a 45% chance that the lower value progressive pool will be selected for growth and remaining 55% chance that the higher value progressive pool will be selected for growth. Again, there may be one probability distribution for determining the contribution amount if the lower value progressive pool is selected and a different probability distribution for the contribution amount if the higher value progressive pool is selected. These two distributions for the contribution amount may also be different from the two distributions at the one dollar wager level so there are four such distributions in total for this particular wagering game. These probability distributions for contributing to the progressive pools may be set up to make the overall pay percentage contribution of the progressives to the two wager levels to be whatever is desired. For example, it could be that the base game (the game played according to the play sequence shown at 402 in FIG. 4, for example) at both wager levels pays 82%, and the progressive prize pools contribute 7% payback at the one dollar wager level producing a total pay percentage of 89% for the wagering game considering both the base game and the progressive games. At the two dollar wager level, the progressive prizes may contribute 8% payback for a total pay percentage of 90% considering both the base game and the progressive games.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for controlling contributions to one or more progressive prize pools used for one or more wagering games, the method including:

(a) receiving a play input for a wagering game through a player input system of a gaming machine, the play input being associated with a wager for the wagering game;

(b) under control of one or more data processing devices associated with the gaming machine, causing a result display system of the gaming machine to display a representation of a result for the play input;

(c) under control of the one or more data processing devices associated with the gaming machine, and separately from a process of obtaining the result for the play input, randomly determining whether a progressive pool growth event is triggered for the play input;

(d) where the progressive pool growth event is triggered for the play input, applying a respective contribution amount to increase at least one of the one or more progressive prize pools;

(e) under control of the one or more data processing devices associated with the gaming machine, awarding any prize associated with the result for the play input; and (f) under control of the one or more data processing devices associated with the gaming machine, awarding a progressive prize from at least one of the one or more progressive pools responsive to the occurrence of a progressive prize triggering event.

2. The method of claim 1, and where the progressive pool growth event is triggered for the play input, further including, under control of the one or more data processing devices associated with the gaming machine, randomly identifying the respective contribution amount to be applied to increase the one or more progressive prize pools.

3. The method of claim 2 wherein the one or more progressive prize pools include at least two different progressive prize pools and wherein identifying the respective contribution amount to be applied to increase the one or more progressive prize pools also identifies which of the at least two different progressive prize pools are to be increased for the play input.

4. The method of claim 1 further including, under control of the one or more data processing devices, determining if the play input is eligible for providing a progressive pool contribution, and wherein determining whether the progressive pool growth event is triggered is performed in response to a determination that the play input is eligible for providing a progressive pool contribution.

5. The method of claim 4 wherein the play input is eligible for providing the progressive prize pool contribution when the result obtained for the play input is not associated with a prize defined in a pay table for the wagering game.

6. The method of claim 1 wherein the one or more progressive prize pools include at least two different progressive prize pools and further including, under the control of the one or more processing devices, identifying which of the at least two different progressive prize pools are to be increased for the play input.

7. The method of claim 1:

(a) further including determining if the wager is at a first wager level defined for the wagering game or is at a second wager level defined for the wagering game, the second wager level being different from the first wager level; and (b) wherein a probability of making the respective contribution for the play input comprises a first probability value when the wager is at the first wager level and the probability of making the respective contribution for the play input comprises a second probability value when the wager is at the second wager level, the first probability value being unequal to the second probability value.

8. The method of claim 7 wherein a contribution apportionment for the play input determines an apportionment of the respective contribution amount for increasing at least two progressive prize pools for that play input.

9. The method of claim 1 wherein a first wager level and a second wager level are defined for the wagering game, the first wager level having a different value than a value of the second wager level, and the method further including:

(a) determining whether the wager is at the first wager level or the second wager level;

(b) selecting the respective contribution amount for the play input according to a first probability distribution when the wager is at the first wager level; and (c) when the wager is at the second wager level, selecting the contribution amount for the play input according to a second probability distribution, different from the first probability distribution.

10. The method of claim 9 further including identifying a contribution apportionment for the play input which determines an apportionment of the respective contribution amount for at least two progressive prize pools.

11. An apparatus for controlling contributions to one or more progressive prize pools used for one or more wagering games, the apparatus including:

(a) a display system;

(b) a player input system;

(c) at least one processor; and (d) at least one memory device storing instructions executable by the at least one processor to:

(i) receive a play input for a wagering game through the player input system, the play input being associated with a wager for the wagering game;

(ii) cause the display system to display a representation of a result for the play input;

(iii) separately from a process of obtaining the result for the play input, randomly determine whether a progressive pool growth event is triggered for the play input;

(iv) where the progressive pool growth event is triggered for the play input, increase at least one of the one or more progressive prize pools by a respective contribution amount;

(v) cause the display system to display an award of any prize associated with the result for the play input; and (vi) responsive to the occurrence of a progressive prize triggering event, cause the display system to display an award of a progressive prize from at least one of the one or more progressive pools.

12. The apparatus of claim 11, where the progressive pool growth event is triggered for the play input, the instructions are executable by the at least one processor to identify the respective contribution amount by which to increase the at least one of the one or more progressive prize pools.

13. The apparatus of claim 11 wherein the instructions are executable by the at least one processor to determine if the play input is eligible for providing a progressive pool contribution, and determining whether the progressive pool growth event is triggered is performed in response to a determination that the play input is eligible for providing a progressive pool contribution.

14. The apparatus of claim 11 wherein the instructions are executable by the at least one processor to determine if the wager is at a first wager level defined for the wagering game or is at a second wager level defined for the wagering game, the second wager level being different from the first wager level, and wherein the probability of making the respective contribution for the play input comprises a first probability value when the wager is at the first wager level and the probability of making the respective contribution for the play input comprises a second probability value when the wager is at the second wager level.

15. A program product comprising one or more non-transitory computer readable data storage devices having program code stored thereon, the program code including:

(a) player input program code executable by at least one processor to receive a play input entered through a player input system of a gaming machine;

(b) game program code executable by the at least one processor to cause a result display system of the gaming machine to display a representation of a result for the play input;

(c) progressive pool control program code executable by the at least one processor to, separately from a process of obtaining the result for the play input, randomly determine whether a progressive pool growth event is triggered for the play input, and, where the progressive pool growth event is triggered, increase at least one of one or more progressive prize pools by a respective contribution amount;

(d) game payout program code executable by the at least one processor to award any prize associated with the result for the play input, the prize being awarded through the gaming machine; and (e) progressive prize payout program code executable by the at least one processor to, responsive to the occurrence of a progressive prize triggering event, award a progressive prize from at least one of the one or more progressive prize pools.

16. The program product of claim 15, where the progressive pool growth event is triggered for the play input, the progressive pool control program code is executable by the at least one processor to identify the respective contribution amount by which to increase the at least one of the one or more progressive prize pools.

17. The program product of claim 15:

(a) wherein the progressive pool control program code is executable by the at least one processor to determine if the wager is at a first wager level defined for the wagering game or is at a second wager level defined for the wagering game, the second wager level being different from the first wager level; and (b) wherein a probability of making the respective contribution for the play input comprises a first probability value when the wager is at the first wager level and the probability of making the respective contribution for the play input comprises a second probability value when the wager is at the second wager level.

18. The program product of claim 15 wherein the one or more progressive prize pools include at least two different progressive prize pools and wherein the progressive pool control program code is also executable to identify which of the at least two different progressive prize pools are to be increased for the play input.

19. The program product of claim 15 wherein a first wager level and a second wager level are defined for the wagering game, the first wager level having a different value than a value of the second wager level, and wherein the progressive pool control program code is executable by the at least one processor to:

(a) determine whether the wager is at the first wager level or the second wager level;

(b) select the respective contribution for the play input according to a first probability distribution when the wager is at the first wager level; and (c) when the wager is at the second wager level, select the respective contribution amount for the play input from a second probability distribution, different from the first probability distribution.

20. The program product of claim 19 wherein the progressive pool control program code is executable by the at least one processor to determine if the play input is eligible for providing a progressive pool contribution, and wherein determining whether the progressive pool growth event is triggered is performed in response to a determination that the play input is eligible for providing a progressive pool contribution.

* * * * *